US011338301B1

(12) United States Patent
Leonard

(10) Patent No.: US 11,338,301 B1
(45) Date of Patent: May 24, 2022

(54) PAN FOR SEPARATING GRANULAR MATERIAL

(71) Applicant: James Leonard, Lewisberry, PA (US)

(72) Inventor: James Leonard, Lewisberry, PA (US)

( * ) Notice: Subject to any disclaimer, the term of this patent is extended or adjusted under 35 U.S.C. 154(b) by 0 days.

(21) Appl. No.: 17/165,586

(22) Filed: Feb. 2, 2021

(51) Int. Cl.
*B03B 5/58* (2006.01)
*B03B 5/02* (2006.01)

(52) U.S. Cl.
CPC . *B03B 5/58* (2013.01); *B03B 5/02* (2013.01)

(58) Field of Classification Search
CPC .... B03B 5/02; B03B 5/04; B03B 5/06; B03B 5/28; B03B 5/38; B03B 5/48; B03B 5/52; B03B 5/58; B03B 5/72; B03B 5/74; B07B 13/113
USPC ..... 209/484, 479, 506
See application file for complete search history.

(56) References Cited

U.S. PATENT DOCUMENTS 1,972,645 A * 9/1934 Danills ..... B03B 5/26 209/447
4,162,969 A * 7/1979 Lagal ..... B03B 5/06 209/447
D268,842 S * 5/1983 Gordon, Jr. ..... D15/147
4,671,868 A * 6/1987 Ottrok ..... C22B 11/10 209/48
5,190,158 A * 3/1993 Remias ..... B03B 5/02 209/397
5,667,076 A * 9/1997 Rosman ..... C22B 11/00 209/447
6,095,342 A * 8/2000 Ashcraft ..... B03B 5/02 209/490
8,113,355 B1 * 2/2012 Peterson ..... B03B 5/02 241/24.1
D663,749 S * 7/2012 Evans ..... D15/21
D776,722 S * 1/2017 Weaver ..... D15/147
9,662,662 B1 * 5/2017 Weaver ..... B03B 5/58
9,676,002 B2 * 6/2017 Guillemin ..... B07B 13/113
2017/0348701 A1 * 12/2017 Washburn ..... B03B 5/06

OTHER PUBLICATIONS

Estwing: Steel Gold Pan https://www.amazon.com/Estwing-12-12-Steel-Gold-Pan/dp/B00DT0P56C?th=1 (Year: 2006).*

* cited by examiner

*Primary Examiner* — Gene O Crawford
*Assistant Examiner* — Muhammad Awais
(74) *Attorney, Agent, or Firm* — Patentfile, LLC; Bradley C. Fach; Steven R. Kick

(57) ABSTRACT

A pan for separating granular material may include a bottom wall and a sidewall. The sidewall may have an upper perimeter and a lower perimeter, and the lower perimeter may be coupled to the bottom wall so that the bottom wall and sidewall are watertight or otherwise configured to hold a volume of water. Preferably, the upper perimeter may be larger in dimension than the lower perimeter. A baffle plate may be coupled to the sidewall so that the baffle plate may be positioned between the upper perimeter and the lower perimeter. The baffle plate may have a proximal surface and an opposing distal surface, and portions of the proximal surface may contact the sidewall. A pocket may be formed between the bottom wall, the first baffle plate, and a portion of the sidewall that is between the bottom wall and sidewall.

19 Claims, 7 Drawing Sheets

PAN FOR SEPARATING GRANULAR MATERIAL

FIELD OF THE INVENTION

This patent specification relates to the field of devices which may be used to separate granular materials from wet mixtures, such as slurries, via wet gravity separation and from dry mixtures, such as dry sediments, via dry gravity separation.

BACKGROUND

Artisanal gold-mining is responsible for more than one third of the planetary mercury poisoning and is the largest of all the Mercury polluters. The vast majority of this pollution coming from these miners is by panning. The convention has asked signatory nations to work on improved capture rates of gold in order to convince miners to stop using Mercury. No nation or pan device has yet been able to achieve the 95% capture rate that would be the tipping point for them to do so. Currently the best pan available has an 86% capture.

All configurations of existing mining pans are limited in their ability to remove tailings without disturbing settled values or desired granular materials that have been concentrated in those pans. This results in the user inadvertently disturbing the concentrate and remixing many of the fine particles of gold or other desired values with the tailings which are then ejected from those pans. Additionally, the values are shifted from their collection point by this turbulent processing and will have to be periodically re-stratified and this process is repeated several times again removing more of the gangue. At each time, more fine gold and other desired values are ejected and lost. It is not uncommon for these existing pans to have losses in the range of 14 to 40 percent or more.

Therefore, a need exists for a novel pan for separating granular material. A further need exists for a novel pan for separating granular material that enables a far greater amount of gold and other desired values to be retained in the pan than is possible using existing pan devices.

BRIEF SUMMARY OF THE INVENTION

A pan for separating granular material is provided. The pan may be used for separating granular material from a slurry without the use of mercury that which is desirable by the US department of State, EPA, United Nations and the other 128 signatories of the Minamata convention as it brings the artisanal mining sector into treaty compliance.

In some embodiments, the pan may include a bottom wall and a sidewall. The sidewall may have an upper perimeter and a lower perimeter, and the lower perimeter may be coupled to the bottom wall so that the bottom wall and sidewall are watertight or otherwise configured to hold a volume of water. Preferably, the upper perimeter may be larger in dimension than the lower perimeter. A baffle plate may be coupled to the sidewall so that the baffle plate may be positioned between the upper perimeter and the lower perimeter. The baffle plate may have a proximal surface and an opposing distal surface, and portions of the proximal surface may contact the sidewall. A pocket may be formed between the bottom wall, the first baffle plate, and a portion of the sidewall that is between the bottom wall and sidewall. Values, such as gold, gems, etc., in a granular material placed in the pan may be separated and retained in the pocket during wet separation or dry separation that may be performed by a user of the pan.

Numerous objects, features and advantages of the present invention will be readily apparent to those of ordinary skill in the art. Some example objects of the present invention are listed below.

One object of the present invention is to provide a granular material separating pan that requires minimal capital cost while delivering greater than 90% capture rate of desired materials, such as gold.

It is another object is to provide a granular material separating pan that does not use riffles thereby allowing for undisturbed stratification of placer.

Another object is to provide a granular material separating pan in which no decanting of material is needed while processing which greatly limits losses.

A further object is to provide a granular material separating pan that provides a higher gold capture rate than panning with mercury amalgam thereby offering a pathway away from toxic mercury processing.

It is another object is to provide a granular material separating pan that is able to decant gangue by rapid mass wasting and only after stratification process and optionally taking less than two seconds.

Another object is to provide a granular material separating pan that is able to achieve necessary capture rates to dissuade Mercury use.

A further object is to provide a granular material separating pan that is able to achieve a high enough values capture rate to satisfy Minamata Convention guidelines for Mercury pollution mitigation.

Another object is to provide a granular material separating pan that is able to eliminate practices by artisanal miners and abandon the use of mercury for processing gold (cost versus profit).

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
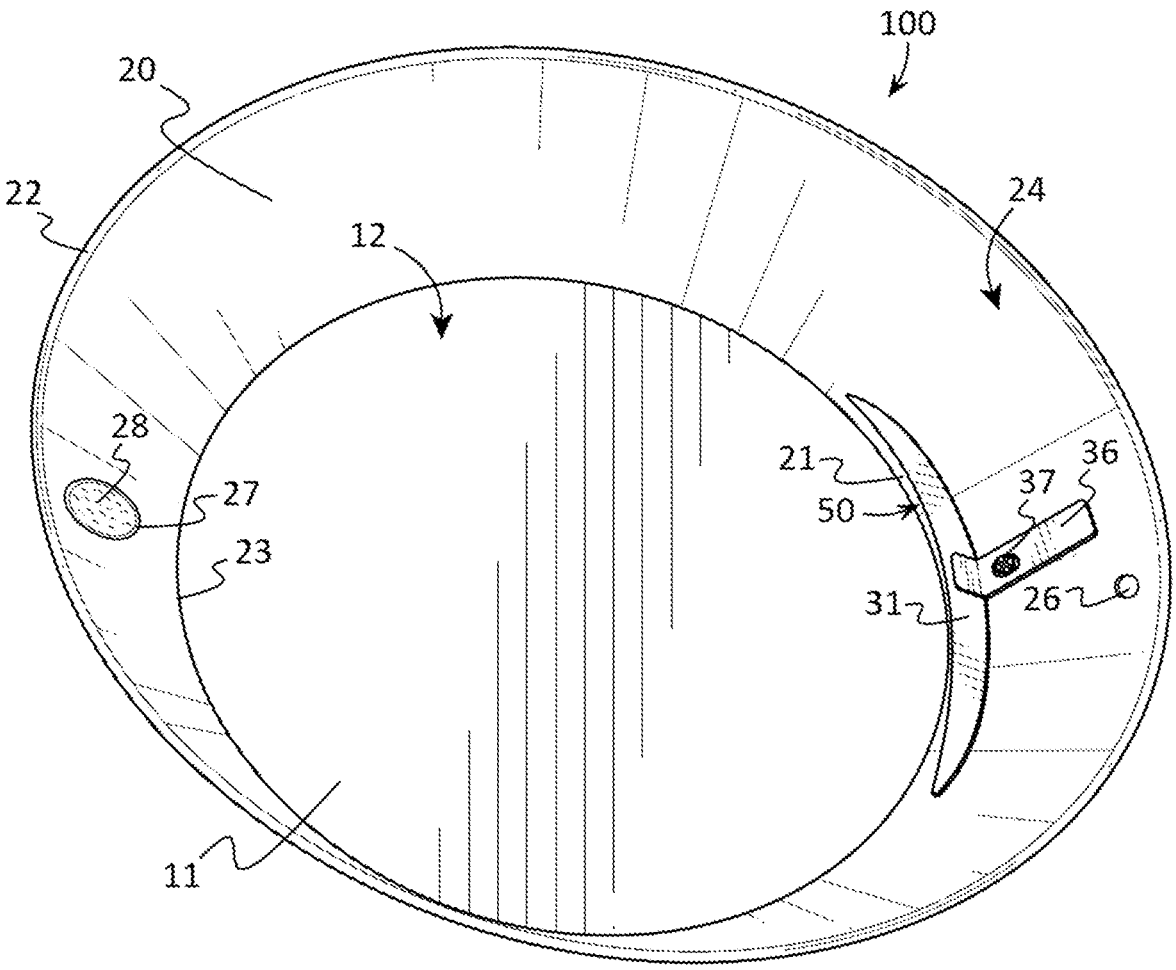
FIG. 1 depicts a top perspective view of an example of a pan for separating granular material according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new pan for separating granular material is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIG. 1 illustrates an example of a pan for separating granular material ("the pan") 100 according to various embodiments. In some embodiments, the pan 100 may comprise a bottom wall 11 and a sidewall 20. The sidewall 20 may have an upper perimeter 22 and a lower perimeter 23, and the lower perimeter 23 may be coupled to the bottom wall 11 so that the bottom wall 11 and sidewall 20 are watertight or otherwise configured to hold a volume of water. Preferably, the upper perimeter 22 may be larger in dimension than the lower perimeter 23. A baffle plate 31 may be coupled to the sidewall 20 so that the baffle plate 31 may be positioned between the upper perimeter 22 and the lower perimeter 23. The baffle plate may have a proximal surface 32 and an opposing distal surface 33, and portions of the proximal surface 32 may contact the sidewall 20. A pocket 50 may be formed between the bottom wall 11, the first baffle plate, and a portion 21 of the sidewall 20 that is between the bottom wall 11 and sidewall 20. Values, such as gold, gems, etc., in a granular material placed in the pan 100 may be separated and retained in the pocket 50 during wet separation or dry separation that may be performed by a user of the pan 100.

The pan 100 may comprise a bottom wall 11 that may be configured in any shape and size. In some embodiments, a bottom wall 11 may be generally flat and planar in shape, such as by being formed of a sheet of metal, sheet of plastic, or other structural and waterproof material. In preferred embodiments, a bottom wall 11 may also be generally circular in shape. A bottom wall 11 may comprise a bottom wall interior surface 12 and a bottom wall exterior surface 13 which may preferably be generally parallel to each other. In preferred embodiments, a bottom wall interior surface 12 and/or a bottom wall exterior surface 13 may be substantially smooth and free of texturing.

The pan 100 may comprise a sidewall 20 that may be configured in any shape and size. In some embodiments, a bottom wall 11 may be generally curved and planar in shape, such as by being formed of a sheet of metal, sheet of plastic, or other structural and waterproof material. A sidewall 20 may comprise a sidewall interior surface 24 and a sidewall exterior surface 25 which may form opposing sides of the sidewall 20. In preferred embodiments, a sidewall interior surface 24 and/or a sidewall exterior surface 25 may be substantially smooth and free of texturing.

A sidewall 20 may comprise an upper perimeter 22 and a lower perimeter 23, and the lower perimeter 23 may be coupled to the bottom wall 11 so that the bottom wall 11 and sidewall are watertight so as to be configured to hold a volume of water, thereby allowing the pan 100 to hold a volume of water or other material. A lower perimeter 23 may be coupled to the bottom wall 11 with heat bonding or welding, adhesive, by being integrally molded or formed together, or with any other suitable coupling method which may be watertight.

An upper perimeter 22 and a lower perimeter 23 may be configured in any size and shape. Generally, a lower perimeter 23 may be complementary in shape to the bottom wall 11. For example, a generally circular bottom wall 11 may be coupled to a generally annular shaped lower perimeter 23. In preferred embodiments, an upper perimeter 22 may be larger in shape than the shape of the lower perimeter 23. In further preferred embodiments, an upper perimeter 22 may comprise an annular or round shape that may be larger than the shape of the lower perimeter 23.

In some embodiments, a sidewall 20 and a bottom wall 11 may be generally configured in the shape of an open and hollow conical frustum which is a frustum created by slicing the top off a cone (with the cut made parallel to the base). A frustrum is the portion of a cone or pyramid which remains after its upper part has been cut off by a plane parallel to its base, or which is intercepted between two such planes. The bottom wall 11 may be generally circular in shape and may form the portion of the conical frustum that would be relatively closer to the apex of the cone while the upper perimeter 22 may be open and may form the portion of the conical frustum that would be relatively farther from the apex of the cone. In this manner the sidewall 20 may be conical in shape. Preferably, a sidewall interior surface 24 may be conical in shape and may be angled away from the bottom wall interior surface 12 between approximately 95 and 170 degrees (with the sidewall interior surface 24 being generally perpendicular to the bottom wall surface 12 at 90 degrees), and more preferably, between approximately 115 and 125 degrees.

In some embodiments, a sidewall 20 may comprise one or more hanging apertures 26 which may extend through the sidewall 20 between a portion of a sidewall interior surface 24 and an opposing portion of a sidewall exterior surface 25. A hanging aperture 26 may allow portions of a nail, wire, or other object to be inserted through the sidewall 20 so that the weight of the pan 100 may be supported by the object that is inserted through the hanging aperture 26 in the sidewall 20. A hanging aperture 26 may be positioned anywhere on a sidewall 20. In preferred embodiments, a hanging aperture 26 may be positioned proximate to the upper perimeter 22 and approximately above a baffle plate 31 or otherwise positioned closer rather than farther to a baffle plate 31 so that when the pan 100 is supported by an object, via the hanging aperture 26, water may drain away from the baffle plate 31 to facilitate draining of the pan 100. A hanging aperture 26 may be configured in any shape and size, such as circular, rectangular, triangular, hexagonal, etc.

In some embodiments, the pan 100 may comprise one or more securement depressions 27 which may be formed into a sidewall 20. Generally, a securement depression 27 may comprise a portion of a sidewall 20 that may be recessed or depressed below the portions of the sidewall interior surface 24 that are adjacent to the securement depression 27. A securement depression 27 may be configured in any size and shape so that one or more fingers, and more preferably a thumb of the user's dominant hand, may be positioned in the securement depression 27 to aid the user in grasping and manipulating the pan 100. For example, a securement depression 27 may comprise a circular, oval, or other shaped depression that the thumb pad of a user may be positioned in. In further embodiments, a securement depression 27 may comprise texturing 28, such as stippling, ridges, dimples, bumps, etc., which may further enhance a user's ability to grasp and manipulate the pan 100 by placing a thumb or finger in the securement depression 27.

A securement depression 27 may be positioned anywhere on a sidewall 20. In preferred embodiments, a securement depression 27 may be positioned so that it is approximately opposite to a portion of the sidewall 20 that a baffle plate 31 may be coupled to. For example, if a pan 100 is being held by a user so that the baffle plate 31 appears to be in the six o'clock orientation, then a securement depression 27 may be positioned in the sidewall 20 so that it is in a twelve o'clock position.

The pan 100 may comprise one or more baffle plates 31 which may be coupled to a sidewall 20. It should be understood that the suffixes of "A", "B", "C", etc., designate different embodiments of the baffle plate 31 so that the baffle plates 31A, 31B, 31C, etc., read on the teachings of baffle plate 31.

A baffle plate 31 may be coupled to the sidewall 20 so that the baffle plate 31 may be positioned between the upper perimeter 22 and the lower perimeter 23. A baffle plate 31 may be configured in any shape and size which may enable portions of the baffle plate 31 to extend away from the sidewall 20 and preferably to extend over a portion of the bottom wall 11. The baffle plate 31 may have a proximal surface 32 and an opposing distal surface 33, and portions of the proximal surface 32 may contact the sidewall 20 while portions of the distal surface 33 may be positioned farthest from the sidewall 20. The proximal surface 32 and distal surface 33 may be separated by a plate upper surface 34 and an opposing plate lower surface 35. Optionally, a baffle plate 31 may be made from or may comprise a sheet of metal, sheet of plastic, or other structural and waterproof material. In preferred embodiments, a baffle plate 31 may be generally planar is shape so that the plate upper surface 34 and plate lower surface 35 may be approximately parallel to each other while the proximal surface 32 may be convex curved. In further preferred embodiments, the plate lower surface 35 may be substantially flat or planar and may also be substantially parallel (plus or minus five degrees) to the bottom wall interior surface 12 so as to extend over a portion of the bottom wall interior surface 12. In further embodiments, the plate lower surface 35 may be angled between approximately plus or minus twenty-five degrees relative to the bottom wall interior surface 12.

All or portions of a proximal surface 32 of a baffle plate 31 may contact the sidewall interior surface 24 when the baffle plate 31 is coupled to a sidewall 20. In preferred embodiments, between 50 to 100 percent of a proximal surface 32 of a baffle plate 31 may contact the sidewall 31 when the baffle plate 31 is coupled to a sidewall 20. For example, when 100 percent of a proximal surface 32 of a baffle plate 31 is contacting a sidewall 20, there may be no gaps or spaces between the proximal surface 32 and sidewall 20. When less than 100 percent of a proximal surface 32 is contacting a sidewall 20, there may be one or more gaps or spaces between the proximal surface 32 and sidewall 20.

A pocket 50 may be formed between the bottom wall 11, the baffle plate 31, and a portion 21 of the sidewall 20 that is between the bottom wall 11 and baffle plate 31 when the baffle plate 31 is coupled to a sidewall 20. Values, such as gold, gems, etc., in a granular material placed in the pan 100 may be separated and retained in the pocket 50 during wet separation or dry separation that may be performed by a user of the pan 100. It should be understood that the suffixes of "A", "B", "C", etc., designate different embodiments of the pocket 50 so that the pockets 50A, 50B, 50C, etc., read on the teachings of pocket 50.

A baffle plate 31 may be configured in any size and shape which may be used to form a pocket 50 of any size and shape. Any suitable coupling method may be used to couple a baffle plate 31 to a sidewall 20 to form a pocket 50 between the bottom wall 11, the first baffle plate, and a portion of the sidewall 20 that is between the bottom wall 11 and sidewall 20.

The size of a baffle plate 31 and the distance that a baffle plate 31 may be positioned from the bottom wall 11 may determine the size of the pocket 50 formed between the bottom wall 11, the baffle plate 31, and a portion 21 of the sidewall 20 that is between the bottom wall 11 and baffle plate 31 when the baffle plate 31 is coupled to a sidewall 20. For example, a relatively larger pocket 50 may be formed by a baffle plate 31 having one or more of the following dimensionings: having a distal surface 33 extend a greater distance away from the sidewall 20; having a larger proximal surface 32; having a plate lower surface 35 with a larger surface area; and having a greater distance between the plate lower surface 35 and the bottom wall interior surface 12. As a further example, a relatively smaller pocket 50 may be formed by a baffle plate 31 having one or more of the following dimensionings: having a distal surface 33 extend a lesser distance away from the sidewall 20; having a smaller proximal surface 32; having a plate lower surface 35 with a smaller surface area; and having a lesser distance between the plate lower surface 35 and the bottom wall interior surface 12.

Figure 9:
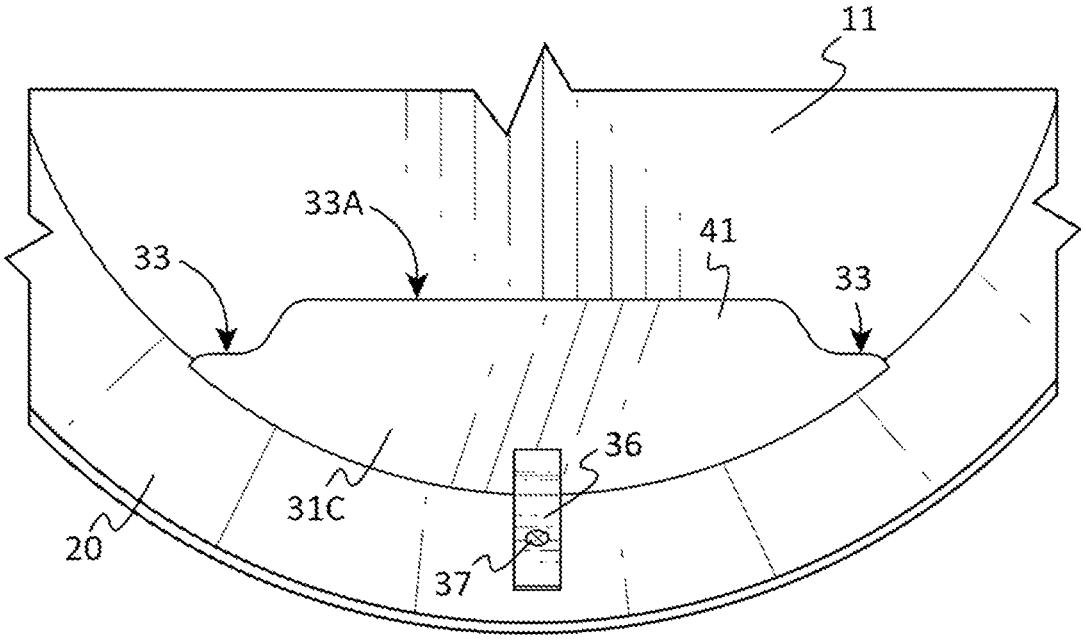
FIG. 9 shows a perspective view of an example of a pan for separating granular material with another example of a baffle plate according to various embodiments described herein.
Figure 10:
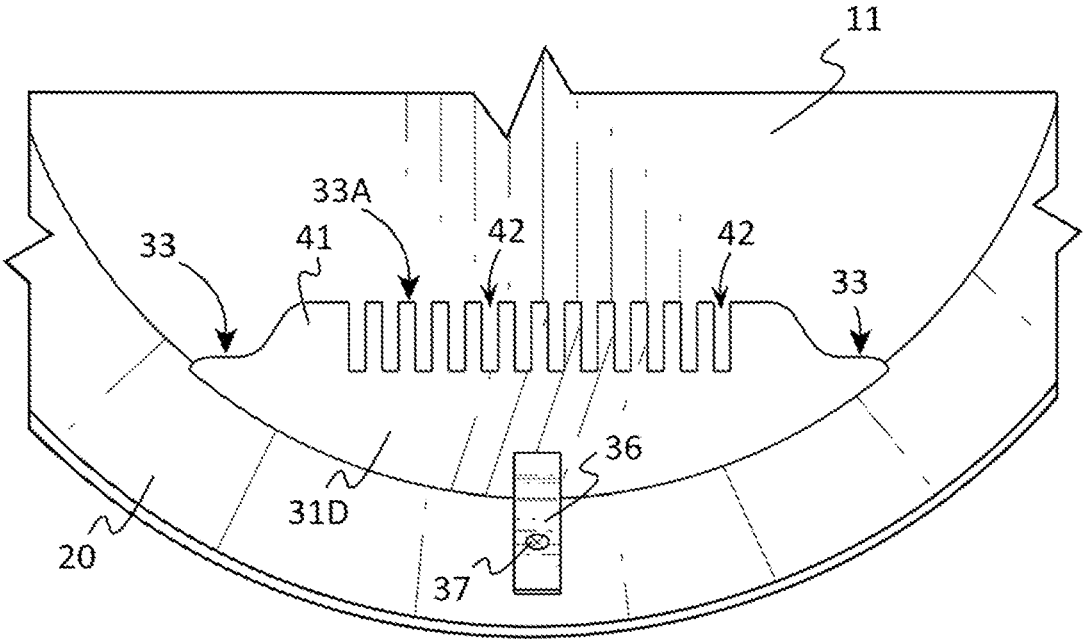
FIG. 10 depicts a perspective view of an example of a pan for separating granular material with a further example of a baffle plate having a number of channels according to various embodiments described herein.

As perhaps best shown by the example baffle plate 31C, 31D, shown in FIGS. 9 and 10, in some embodiments, a baffle plate 31 may comprise a plate projection 41 which may extend a greater distance away from a sidewall 21 that the baffle plate 31C, 31D, is coupled to than other portions of the baffle plate 31. Likewise, portions 33A of the distal surface 33 formed by the plate projection 41 may also extend a greater distance away from a sidewall 21 that the baffle plate 31C, 31D, is coupled to than other portions of the distal surface 33.

As perhaps best shown by the example baffle plate 31D, shown in FIG. 10, in some embodiments, a baffle plate 31 may comprise one or more channels 42. A channel 42 may be formed in the baffle plate 31 by cutting away portions of the baffle plate 31, by being molded into the baffle plate 31, or any other suitable method. Generally, a channel 42 may be formed in a baffle plate 31 so that the channel 42 is open to the distal surface 33, 33A, that the channel is in communication with or otherwise formed into. Channels 42 may enable water, sand, dirt, and other relatively smaller materials that are able to fit through the channels 42 to exit out of the pocket 50 formed by the baffle plate 31 while trapping relatively larger materials, such as gemstones, precious metal nuggets, etc., in the pocket 50.

In some embodiments, a pan 100 may comprise a mounting strap 36 which may be placed into contact with the sidewall 20 when a baffle plate 31 is coupled to a sidewall 20. A mounting strap 36 may be configured in any shape and size. Optionally, a mounting strap 36 may be made from or may comprise a sheet of metal, sheet of plastic, or other structural and waterproof material. In some embodiments, a baffle plate 31 may be coupled directly to a sidewall 20. In further embodiments, a baffle plate 31 may be coupled indirectly to a sidewall 20 via a mounting strap 36 which may be coupled to both the baffle plate 31 and sidewall 20.

In some embodiments, a baffle plate 31 may be coupled to a sidewall in a generally non-movable or non-removable manner. For example, a baffle plate 31 and/or a mounting strap 36 coupled to the baffle plate 31 may be coupled to a sidewall 20 via welding or heat bonding, adhesive, by being integrally formed or molded together etc. As another example, a baffle plate 31 and/or a mounting strap 36 coupled to the baffle plate 31 may be coupled to a sidewall 20 via a generally non-removably retainer 38, such as a rivet.

In some embodiments, a baffle plate 31 may be removably coupled to a sidewall 20. For example, a baffle plate 31 and/or a mounting strap 36 coupled to the baffle plate 31 may be coupled to a sidewall 20 via one or more threaded retainers 37, such as screws, bolts, nuts, etc. In preferred embodiments, a mounting strap 36 may be coupled to a baffle plate 31, and one or more retainers 37 may removably couple the mounting strap 36, and therefore the baffle plate 31, to the sidewall 20. A retainer 37 may comprise any type of fastening or coupling device including male fasteners 38, such as screws, thumbscrews, bolts, etc., and female fasteners 39, such as nuts, wingnuts, or any other fastener which may removably receive or mate with a male fastener 38. Optionally, portions of a sidewall 20, baffle plate 31 and/or a mounting strap 36 may be coupled together between a male fastener 38, such as a machine screw, and female fastener 39, such as a wingnut or other hand tighten-able fastener, that are coupled to each other. In some embodiments, a mounting strap 36 may comprise a strap aperture 40 and the sidewall 20 may comprise a sidewall aperture 29, and the retainer 37 may removably couple the mounting strap 36 to the sidewall 20 by having a male fastener 38 of the retainer 37 inserted through the apertures 29, 40, and by having a removable female fastener 39 of the retainer 37 mate with the male fastener 38 and tension the mounting strap 36 and sidewall 20 together.

In some embodiments, a baffle plate 31 may be movably coupled to a sidewall 20 so that the distance between the plate lower surface 35 and the bottom wall interior surface 12 may be decreased by moving and positioning the baffle plate 31 in a first position 71 and so that the distance between the plate lower surface 35 and the bottom wall interior surface 12 may be increased by moving and positioning the baffle plate 31 in a first second position 72. In preferred embodiments, when in a first position 71 a plate lower surface 35 and the bottom wall interior surface 12 may be separated by between approximately 0.05 and 0.2 inches. In further preferred embodiments, when in a second position 72 a plate lower surface 35 and the bottom wall interior surface 12 may be separated by between approximately 0.2 and 1.0 inches.

Figure 8:
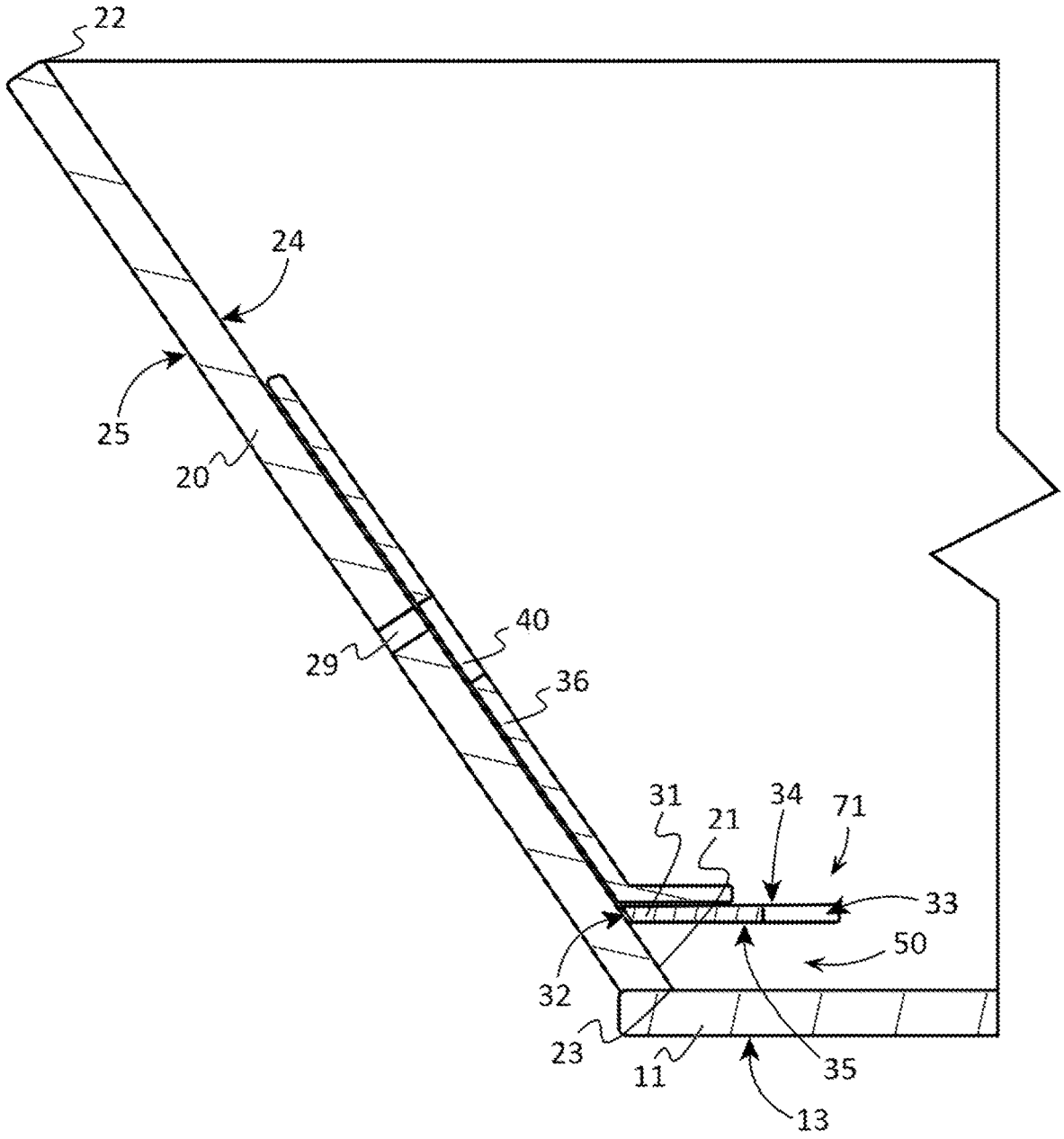
FIG. 8 illustrates a partial sectional elevation view of an example of a pan for separating granular material showing a size comparison between an example sidewall aperture and an example strap aperture according to various embodiments described herein.

Any suitable movably coupling method may be used to enable a baffle plate 31 to be moved between a first 71 and second position 72. In preferred embodiments, a mounting strap 36 may be coupled to a baffle plate 31, and the mounting strap 31 may comprise a strap aperture 40. A sidewall 20 may comprise a sidewall aperture 29, and the strap aperture 40 may be larger than the sidewall aperture 29 as perhaps best shown in FIG. 8. For example, the sidewall aperture 29 may be circular in shape having a 0.25 inch diameter, and the strap aperture 40 may be generally stadium shaped having a smaller diameter dimension of 0.25 inches and a larger diameter dimension of 0.4375 inches with the larger diameter extending towards the upper perimeter 22 and lower perimeter 23 to enable the baffle plate 31 to move approximately 3/16 of an inch between the first 71 and second 72 positions. A retainer 37 may movably couple the mounting strap 36 to the sidewall 20 by having a male fastener 38 of the retainer 37 inserted through the apertures 29, 40, and by having a removable female fastener 39 of the retainer 37 mate with the male fastener 38 and tension the mounting strap 36 and sidewall 20 together. Continuing the above example, the larger diameter dimension of the strap aperture 40 may allow the mounting strap 36, and therefore the baffle plate 31 that it is coupled to, to be moved approximately 0.5 inches between the first position 71 and second position 72.

In some embodiments, the pan 100 may comprise two or more baffle plates 31. In some embodiments, the pan 100 may comprise two or more baffle plates 31 which may be simultaneously coupled to the sidewall 20 at different portions of the sidewall 20. For example, a pan 100 may comprise a first baffle plate 31 and a second baffle plate 31 which may each be coupled to opposing portions of the sidewall 20 so that the baffle plates 31 may generally be positioned on opposite sides of the sidewall 20.

In further embodiments, the pan 100 may comprise two or more baffle plates 31 which may be interchangeably coupled, and therefore removably coupled, to a portion of the sidewall 20 so that a user may replace the baffle plates 31 and more preferably select and couple a desired baffle plate 31 to the sidewall 20. For example, the pan 100 may comprise a first baffle plate 31 and a second baffle plate 31 which may be coupled to a first mounting strap 36 and a second mounting strap 36, respectively. The sidewall 20 may comprise a sidewall aperture 29 and each mounting strap 36 may have a strap aperture 40. A user may select either the first or second baffle plate 31 and then couple the selected baffle plate 31 to the sidewall 20, such as by inserting a retainer 37 though the sidewall aperture 29 and strap aperture 40 of the selected baffle plate 31.

Figure 2:
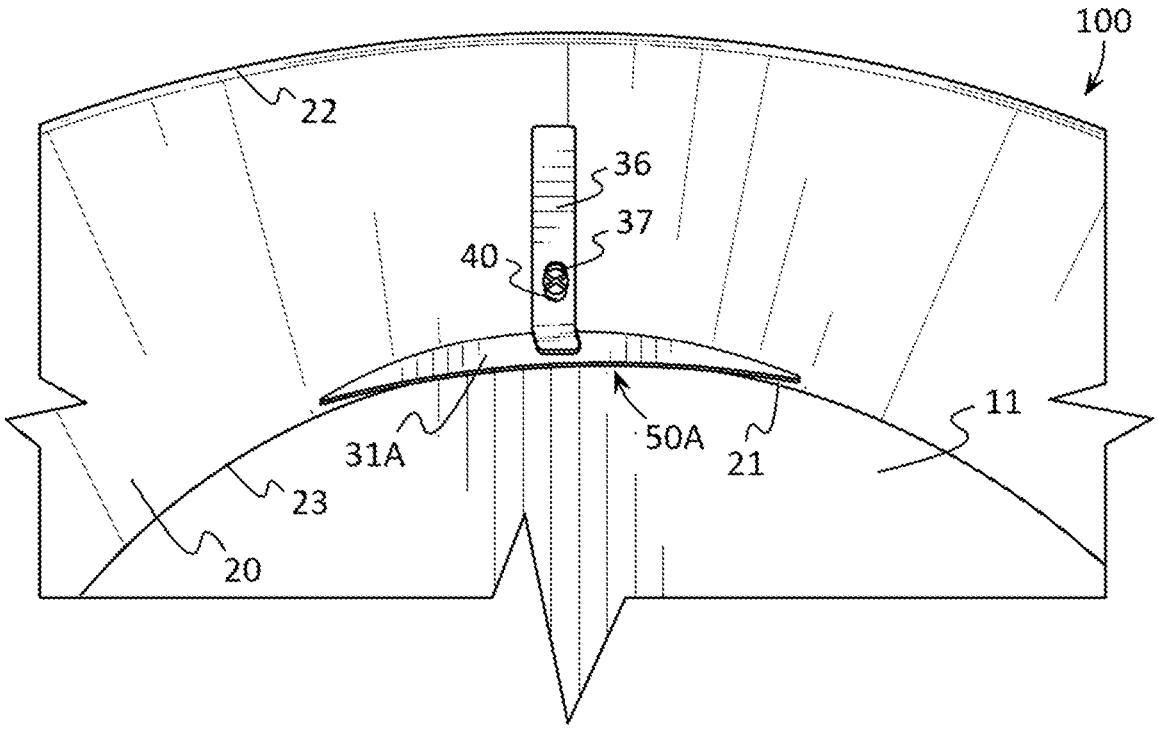
FIG. 2 illustrates a perspective view of an example of a pan for separating granular material having a relatively smaller baffle plate according to various embodiments described herein.
Figure 3:
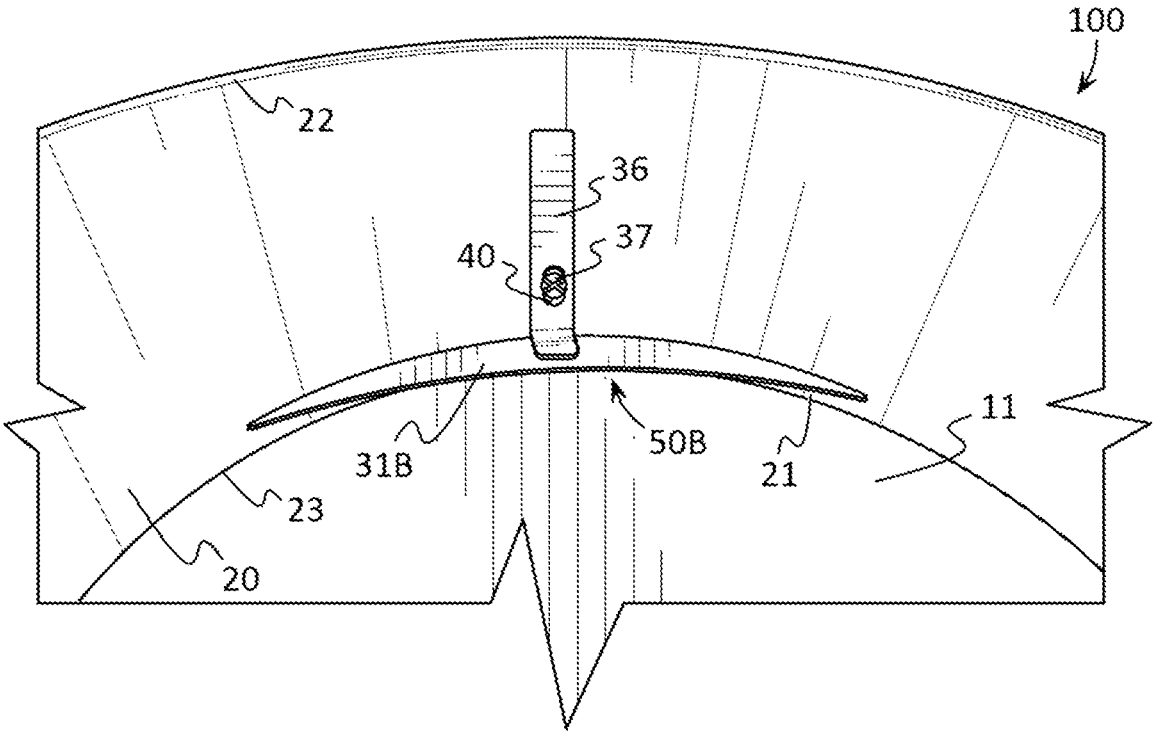
FIG. 3 shows a perspective view of an example of a pan for separating granular material having a relatively larger baffle plate according to various embodiments described herein.
Figure 4:
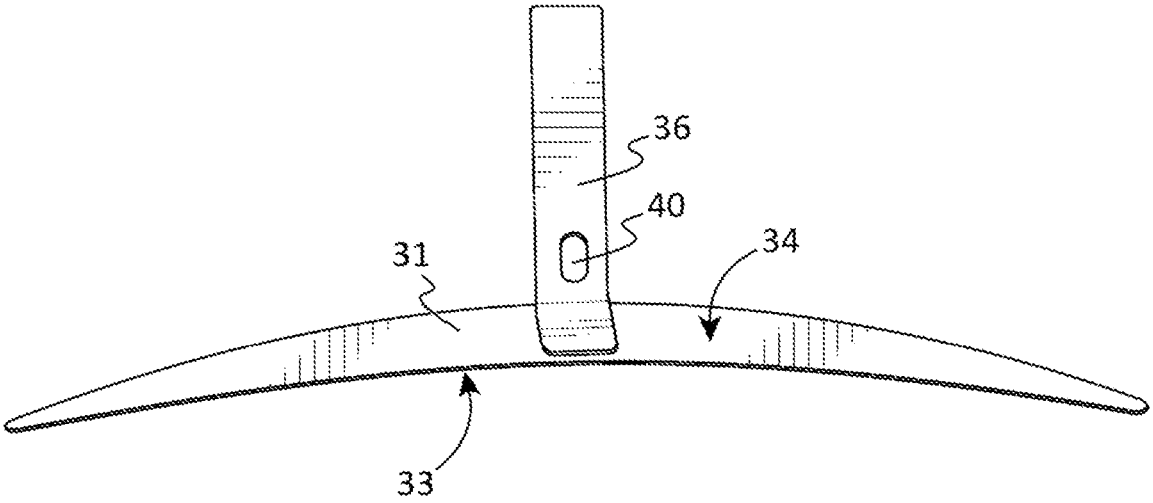
FIG. 4 depicts a front perspective view of an example of a baffle plate according to various embodiments described herein.
Figure 5:
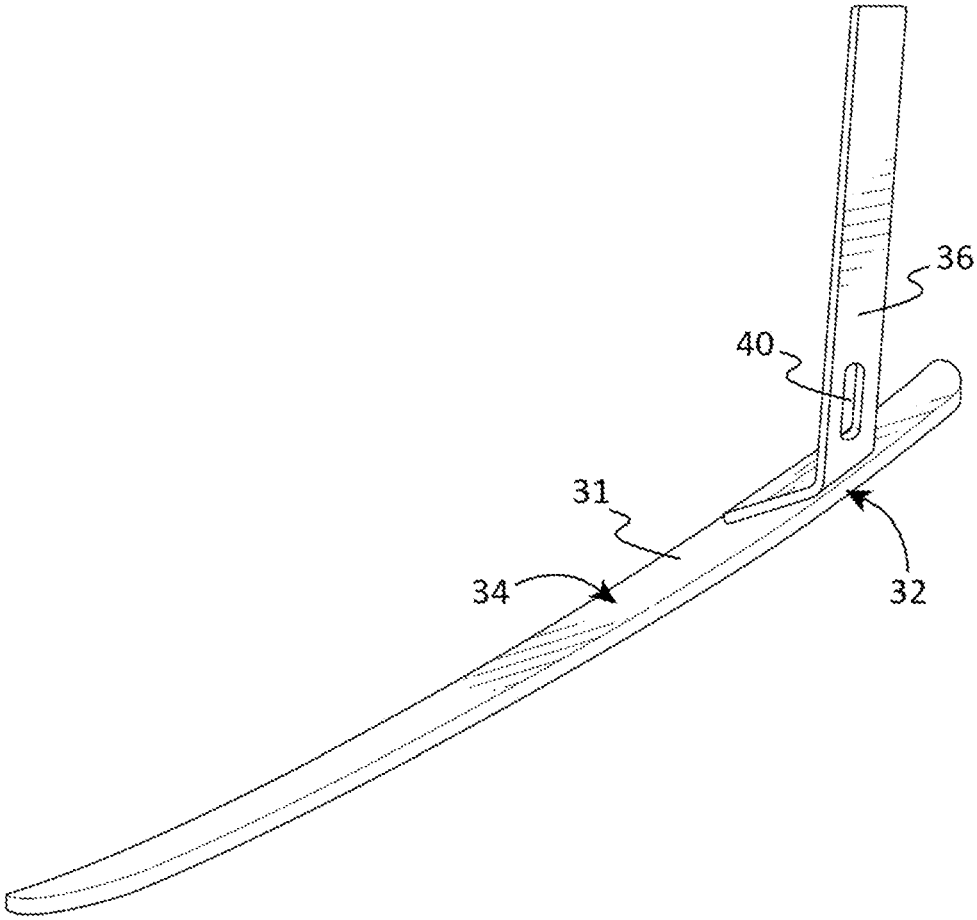
FIG. 5 illustrates a side perspective view of an example of a baffle plate according to various embodiments described herein.
Figure 6:
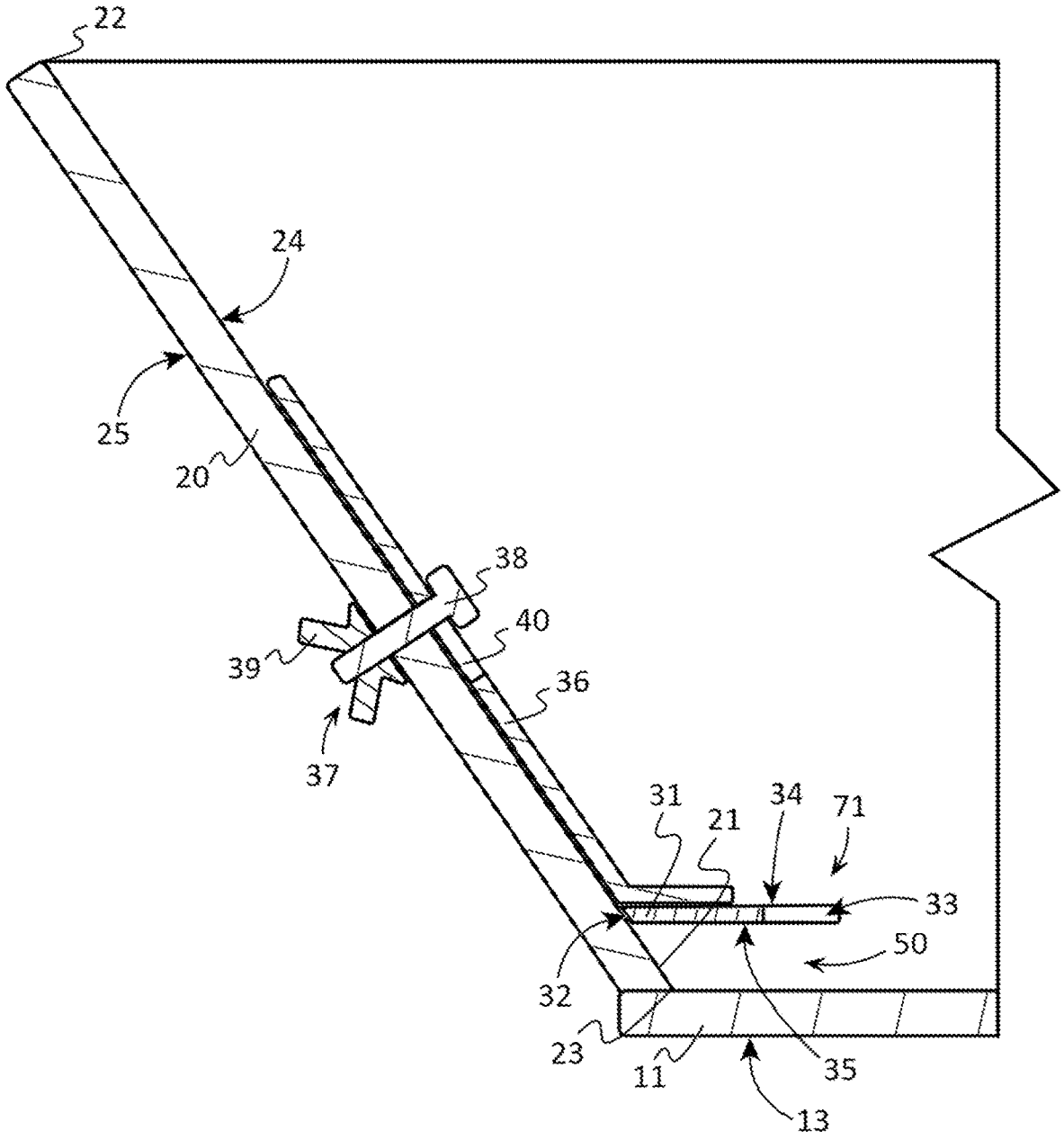
FIG. 6 shows a partial sectional elevation view of an example of a pan for separating granular material having a baffle plate in a first position according to various embodiments described herein.
Figure 7:
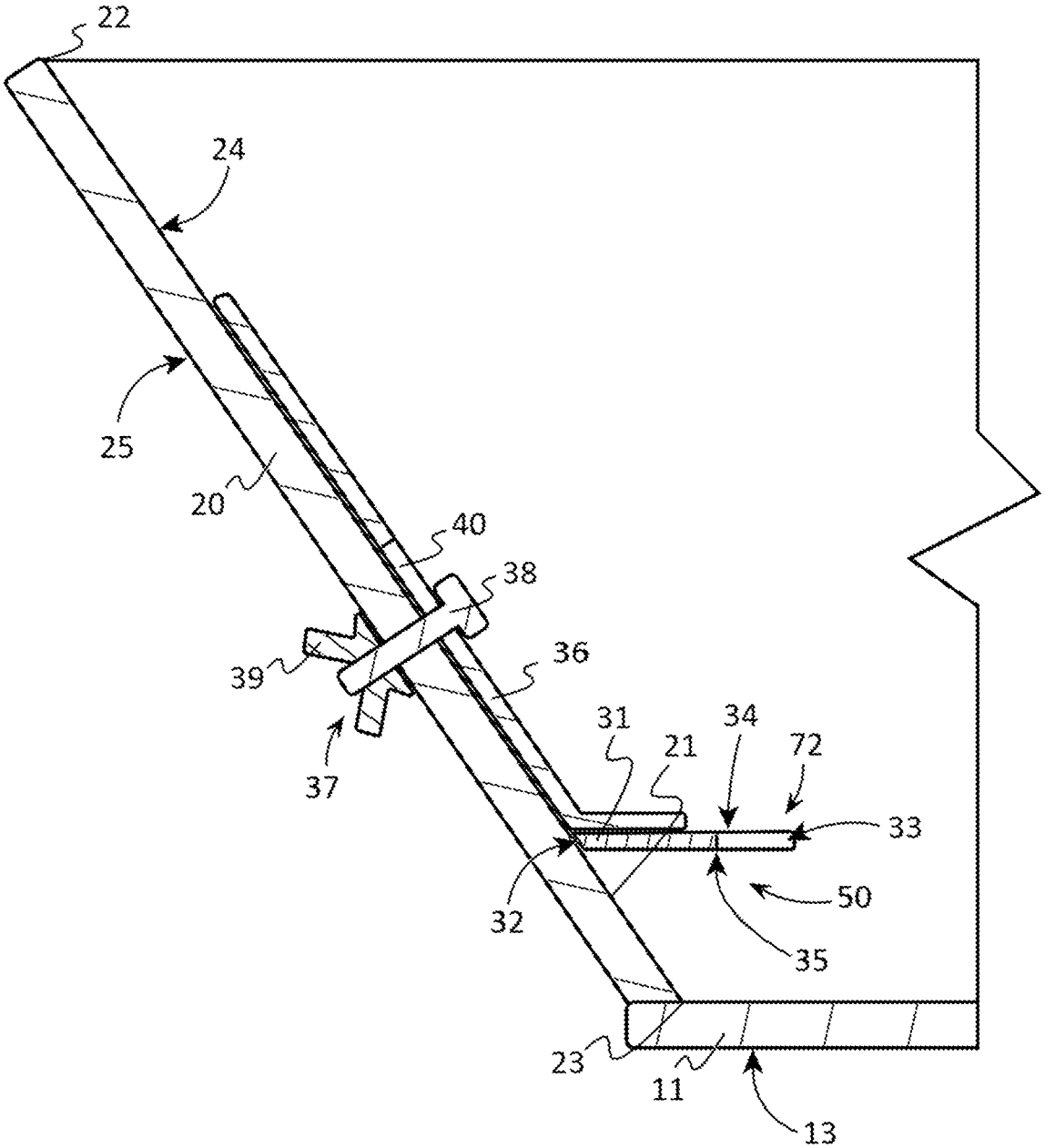
FIG. 7 depicts a partial sectional elevation view of an example of a pan for separating granular material having a baffle plate in a second position according to various embodiments described herein.

As perhaps best shown in FIGS. 2 and 3 and in preferred embodiments, a pan 100 may comprise a first baffle plate 31A and a second baffle plate 31B, and the second baffle plate 31B may be larger in dimension than the first baffle plate 31A. A first pocket 50A may be formed between the bottom wall 11, the first baffle plate 31A, and a portion 21 of the sidewall 20 that is between the bottom wall 11 and the first baffle plate 31A when the first baffle plate 31A is coupled to the sidewall 20. Likewise, a second pocket 50B may be formed between the bottom wall 11, the second baffle plate 31B, and a portion 21 of the sidewall 20 that is between the bottom wall 11 and the second baffle plate 31B when the second baffle plate 31B is coupled to the sidewall 20. By the second baffle plate 31B being larger in one or more dimensions than the first baffle plate 31A, a second pocket 50B formed by the second baffle plate 31B being coupled to the sidewall 20 may be larger than a first pocket 50A formed by the first baffle plate 31B being coupled to the sidewall 20.

While some exemplary shapes and sizes have been provided for elements of the pan 100, it should be understood to one of ordinary skill in the art that the bottom wall 11, sidewall 20, baffle plate 31, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the pan 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the pan 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the pan 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the pan 100 may be coupled by being one of connected to and integrally formed with another element of the pan 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A pan for separating granular material, the pan comprising:

a bottom wall;

a sidewall having an upper perimeter and a lower perimeter, the lower perimeter coupled to the bottom wall so that the bottom wall and sidewall are configured to hold a volume of water, and the upper perimeter being larger in dimension than the lower perimeter;

a first baffle plate coupled to the sidewall so that the first baffle plate is positioned between the upper perimeter and the lower perimeter, the first baffle plate having a first proximal surface and an opposing first distal surface, wherein portions of the proximal surface contact the sidewall; and a first pocket formed between the bottom wall, the first baffle plate, and a portion of the sidewall that is between the bottom wall and the first baffle plate; and wherein the first baffle plate is movable between a first and a second position, and wherein the first baffle plate is positioned closer to the bottom wall when the first baffle plate is in the first position.

2. The pan of claim 1, further comprising a first mounting strap that is coupled to the first baffle plate, and wherein a retainer removably couples the mounting strap to the sidewall.

3. The pan of claim 2, wherein the first mounting strap comprises a first strap aperture and the sidewall comprises a sidewall aperture, and wherein the retainer is inserted through the strap aperture and the sidewall aperture.

4. The pan of claim 3, wherein the strap aperture is larger than the sidewall aperture.

5. The pan of claim 1, wherein between 50 to 100 percent of the proximal surface contacts the sidewall.

6. The pan of claim 1, wherein the sidewall is conical in shape.

7. The pan of claim 1, further comprising a second mounting strap coupled to a second baffle plate, wherein a second pocket is formed between the bottom wall and the second baffle plate when the second baffle plate is coupled to the sidewall, and wherein the first mounting strap and second mounting strap are configured to be interchangeably coupled to the sidewall via the retainer.

8. The pan of claim 7, wherein the second baffle plate is larger in dimension than the first baffle plate so that the second pocket is larger than the first pocket.

9. The pan of claim 1, wherein a channel is formed in the first baffle plate, the channel open to the first distal surface.

10. The pan of claim 1, wherein the baffle plate comprises a plate lower surface, wherein the bottom wall comprises a bottom wall interior surface, and wherein the plate lower surface is substantially parallel to the bottom wall interior surface.

11. The pan of claim 1, wherein the pan includes a hanging aperture in the sidewall.

12. The pan of claim 1, wherein the pan includes a securement depression in the sidewall.

13. A pan for separating granular material, the pan comprising:

a bottom wall;

a sidewall having an upper perimeter and a lower perimeter, the lower perimeter coupled to the bottom wall so that the bottom wall and sidewall are configured to hold a volume of water, and the upper perimeter being larger in dimension than the lower perimeter;

a first baffle plate coupled to the sidewall so that the first baffle plate is positioned between the upper perimeter and the lower perimeter, the first baffle plate having a first proximal surface and an opposing first distal surface, wherein portions of the proximal surface contact the sidewall, wherein the first baffle plate is movable between a first and a second position, and wherein the first baffle plate is positioned closer to the bottom wall when the first baffle plate is in the first position, and wherein between 50 to 100 percent of the proximal surface contacts the sidewall; and a first pocket formed between the bottom wall, the first baffle plate, and a portion of the sidewall that is between the bottom wall and the first baffle plate.

14. The pan of claim 13, further comprising a first mounting strap that is coupled to the first baffle plate, and wherein a retainer removably couples the mounting strap to the sidewall.

15. The pan of claim 14, wherein the first mounting strap comprises a first strap aperture and the sidewall comprises a sidewall aperture, and wherein the retainer is inserted through the strap aperture and the sidewall aperture, and wherein the strap aperture is larger than the sidewall aperture.

16. The pan of claim 13, wherein the sidewall is conical in shape.

17. The pan of claim 13, further comprising a second mounting strap coupled to a second baffle plate, wherein a second pocket is formed between the bottom wall and the second baffle plate when the second baffle plate is coupled to the sidewall, wherein the first mounting strap and second mounting strap are configured to be interchangeably coupled to the sidewall via the retainer, and wherein the second baffle plate is larger in dimension than the first baffle plate so that the second pocket is larger than the first pocket.

18. The pan of claim 13, wherein a channel is formed in the first baffle plate, the channel open to the first distal surface.

19. The pan of claim 13, wherein the pan includes a hanging aperture in the sidewall, and wherein the pan includes a securement depression in the sidewall.

* * * * *